US006953905B2

(12) United States Patent
Adams

(10) Patent No.: US 6,953,905 B2
(45) Date of Patent: Oct. 11, 2005

(54) ELECTRICAL SWITCH

(75) Inventor: Edward Roger Adams, Englewood, TN (US)

(73) Assignee: Maxera LLC, Englewood, TN (US)

( * ) Notice: Subject to any disclaimer, the term of this patent is extended or adjusted under 35 U.S.C. 154(b) by 18 days.

(21) Appl. No.: 10/447,641

(22) Filed: May 29, 2003

(65) Prior Publication Data

US 2004/0011635 A1 Jan. 22, 2004

Related U.S. Application Data

(60) Provisional application No. 60/396,844, filed on Jul. 18, 2002.

(51) Int. Cl.[7] ..... H01H 3/42
(52) U.S. Cl. ..... 200/533; 200/523; 200/434
(58) Field of Search ..... 200/19.2, 520–524, 200/533, 16 D, 16 R, 16 C, 434

(56) References Cited

U.S. PATENT DOCUMENTS 4,807,096 A 2/1989 Skogler et al.
4,891,475 A * 1/1990 Wiersing et al. ..... 200/5 R
5,649,756 A 7/1997 Adams et al.
5,669,698 A 9/1997 Veldman et al.
5,670,762 A * 9/1997 Futamura ..... 200/16 D
5,820,245 A 10/1998 Desmond et al.
6,028,279 A * 2/2000 Suryan et al. ..... 200/524
6,124,556 A * 9/2000 Thalhammer ..... 200/16 R
6,386,742 B1 5/2002 DeLine et al.
6,433,291 B1 * 8/2002 Mori et al. ..... 200/437

FOREIGN PATENT DOCUMENTS

EP 615882 A2 9/1994

* cited by examiner

*Primary Examiner*—Richard K. Lee
(74) *Attorney, Agent, or Firm*—Van Dyke, Gardner, Linn & Burkhart, LLP

(57) ABSTRACT

An electrical switch for low to medium wattage applications such as in vehicles, appliances, and the like, includes a flexible, resilient spring member which is operable mechanically to latch the switch in one of two positions while also carrying electrical current to complete an electrical circuit when the switch is closed in one of the two latched positions. The switch may operate in either single pole, single throw or single pole, double throw configuration, and provides at least one audible sound or click in each of its latched positions to indicate its status, and also may include a visual indication of status. Preferably, a conductive, metallic, coil spring is carried by a non-conductive switch actuator, the spring having a contact member that is moved between latched positions by finger pressure of an operator on the actuator to open and close one or more electrical circuits connected to the switch contacts.

41 Claims, 7 Drawing Sheets

ELECTRICAL SWITCH

CROSS-REFERENCE TO RELATED APPLICATION

This application claims priority from U.S. Provisional Patent Application Ser. No. 60/396,844, filed Jul. 18, 2002, entitled DPDT PUSH/PUSH LATCHING ELECTRICAL SWITCH, invented by Edward Roger Adams.

FIELD OF THE INVENTION

This invention relates to electrical switches, especially of the type for use with accessories and other controls in vehicles, appliances, and other applications and, more particularly, to a latching-type, push/push, single pole, single or double throw electrical switches.

BACKGROUND OF THE INVENTION

A wide variety of electrical accessories and controls used in vehicles are operated with electrical switches. As one example, interior rearview mirror assemblies in vehicles now often incorporate map or reading lights or other accessories which are controlled by electrical switches. Typically, such switches operate by pushing an actuator or button causing the switch to move from a first position in which the light or other accessory is operated to a second position in which the light or other accessory is turned off. Various types of switches are useful in such assemblies including rocker-type or push/push switches. For example, U.S. Pat. No. 4,807,096 to Skogler et al. and U.S. Pat. No. 5,649,756 to Adams et al. disclose interior rearview mirror assemblies that each incorporate a pair of rocker type, single pole, double thrown switches for operating lights within the mirror assembly. More recently, push/push type electrical switches have been incorporated in rearview mirror assemblies as shown in U.S. Pat. No. 5,669,698 to Veldman et al., U.S. Pat. No. 5,820,245 to Desmond et al., U.S. Pat. No. 6,386,742 to DeLine et al., and European Patent Application No. 615882 A2. The switches shown in DeLine et al. U.S. Pat. No. 6,386,742 include actuating plungers extending downwardly through apertures in the rearview mirror housing. The plungers are adapted to be depressed to operate the switches and to extend farther outwardly away from the mirror assembly when the switch is in the "on" position.

While many prior known switches have operated adequately to control such vehicle accessories, each is a relatively expensive collection of numerous small parts which are difficult to assemble, are often misassembled and, consequently, fail to operate as desired. Because of the number of small pieces involved, the cost of each switch is relatively large. In addition to the cost and reliability issues for the switches themselves, the prior switches have been difficult and time consuming to assemble to the electrical circuits used in rearview mirrors, thereby adding to the overall cost of the assembly.

It was, therefore, desired to obtain an electrical switch useful in low to medium voltage/current/wattage applications such as in a vehicle for vehicle accessories and controls, or in a household appliance to control relays which control household current to electric motors or the like, which has fewer operational parts, is more reliable, has a longer lifespan than currently available switches, and is less expensive to manufacture and use.

SUMMARY OF THE INVENTION

Accordingly, the present invention provides an electrical switch especially adapted for use in applications such as vehicle accessories and controls, household appliances, and other applications which incorporates a significantly lower number of operational parts than prior known switches, is reliable yet cost efficient in both manufacture and use, and operates as a push/push, latching-type switch that is useful in a large number of applications, and especially low to medium current/voltage applications. In addition, the invention provides both visual and audible indications of switch status and operation.

In one form, the invention is an electrical switch for vehicles, appliances, and the like, comprising a first electrical switch contact at a first position, an electrically conductive, resilient spring member having a first portion engaged with the first electrical switch contact and a second portion movable between second and third positions, the second and third positions being spaced from one another and from the first position. A second electrical switch contact is at one of the second and third positions. When the first and second electrical switch contacts are connected to an electrical circuit, movement of the second portion of the spring member between the second and third positions engages and disengages the second spring portion with the second electrical switch contact to thereby open the electrical circuit or close the electrical circuit allowing current to pass through the spring member.

In other aspects, the invention includes a contact directing member positioned between the second and third positions, the contact directing member including a cam surface that directs the second portion of the spring member between the second and third positions for engagement as disengagement with the second electrical switch contact. The switch may also include a second contact directing member between the second and third positions, the second contact directing member including a second cam surface that directs the second portion of the spring member from the third to the second position.

In yet other aspects of the invention, the spring may be either a flat spring with the second portion of the spring member extending at a right angle to the first portion of the spring member, or a coil spring having a coil with two ends, an axis for the coil, a first arm at one end of the coil extending outwardly away from the coil axis, and a second arm at the other end of the coil also extending outwardly away from the coil axis. The first arm is the first portion of the spring member and the second arm is second portion of the spring member.

In one preferred form of the invention, the switch includes a non-electrically conductive switch actuator movable between at least two positions, the spring being mounted on and movable with the actuator. In one form, the switch actuator is movable linearly along a first direction while the cam surface directs the second portion of the spring member in a second direction laterally of the first direction. The second cam surface directs the second portion of the spring member in a third direction different from the first and second directions. The switch actuator may be mounted on switch support which, in preferred versions of the invention, may comprise a molded circuit support which includes insert molded circuit members or bus bars, lamps or bulb holders, or other accessories. The first and second electrical switch contacts are on the switch support in this embodiment.

In other aspects of the invention, the resiliency of the spring member urges the switch actuator toward one of two latched actuator positions when the second spring portion is in the second and third positions. In addition, when the second portion of the spring member engages the second electrical switch contact, an audible sound is produced giving an indication of switch operation. Likewise, another audible sound is produced when the second spring portion is moved from the second electrical switch contact to the first electrical switch contact. Preferably, the spring member is mounted on a post on the non-electrically conductive switch actuator and, when the spring is a coil spring, it has an extending arm engaging the first electrical switch contact formed on the switch support while the second portion of the coil spring is movable in at least two dimensions between first and second stop members, at least one of which is the second electrical switch contact when a force is applied to move the switch actuator. When only one of the stop members is electrically conductive and connected to the electrical circuit, the switch functions as a single pole, single throw switch. When both stop members are electrically conductive and connected to the electrical circuit, the switch functions as a single pole, double throw switch.

Accordingly, the present invention provides a reliable, low cost electrical switch especially useful for use low to medium current, voltage and wattage applications such as in vehicles, appliances, and the like. The switch combines a mechanical action, preferably a push/push action, with electrical conductivity, and may be configured to operate either as a single pole, single throw or single pole, double throw switch. Preferably, the switch is operated by a spring member which doubles as an electrical current conductor. The mechanical action of the spring is combined with the engagement or disengagement of a portion of the spring with electrical switch contacts to open and close the desired electrical circuit wherein electricity is allowed to flow through or is stopped from flowing through the spring itself.

The present invention provides numerous benefits and advantages over prior known switches. Various types of electrically conductive springs may be used in the switch such as round wire, coil springs, flat wire springs, and the like. An operational force can be directly applied to the spring conductor itself since the current conveyed is at only a low to medium voltage thereby avoiding injury to an operator. Alternately, an operational force can be applied via a non-conductive switch actuator on which the current conducting spring is mounted. Portions of the conductive spring can move in two or three dimensions, such movement being combined with the resilience of the spring to enable the production of audible sounds or clicks when the switch moves from one position to another to indicate switch operation. The switch may be incorporated directly on lead frames or circuit members thereby avoiding time consuming, difficult assembly operations. Moreover, the switch can be adapted to be in its on position with the switch actuator or button/plunger either depressed or extended thereby also indicating its status visually. Also, the switch actuator itself can be designed to move in various ways for stability and reliability, and may be used in either single pole, single throw, or single pole double pole applications.

These and other objects, advantages, purposes and features of the invention will become more apparent from a study of the following description taken in conjunction with the drawings.

DESCRIPTION OF THE PREFERRED EMBODIMENTS

Figure 1:
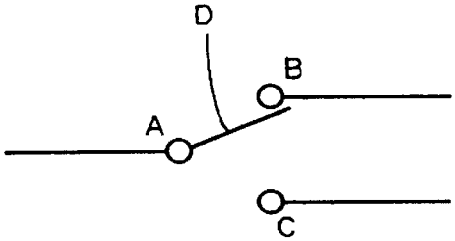
FIG. 1 (PRIOR ART)
FIG. 1 is a schematic illustration of a single pole, double throw switch commonly known in the prior art.

Referring now to the drawings in greater detail, FIG. 1 shows a schematic illustration of a conventional, single pole, double throw switch in which electrical current from contact A is moved between alternate contacts B and C by means of a movable switch contact D. FIG. 1 illustrates the general principle of the operation of the electromechanical switches of the present invention, although the present switch may also be used as a single pole, single throw switch when only one or the other of contacts B and C is actually connected to an electrical circuit.

Figure 2:
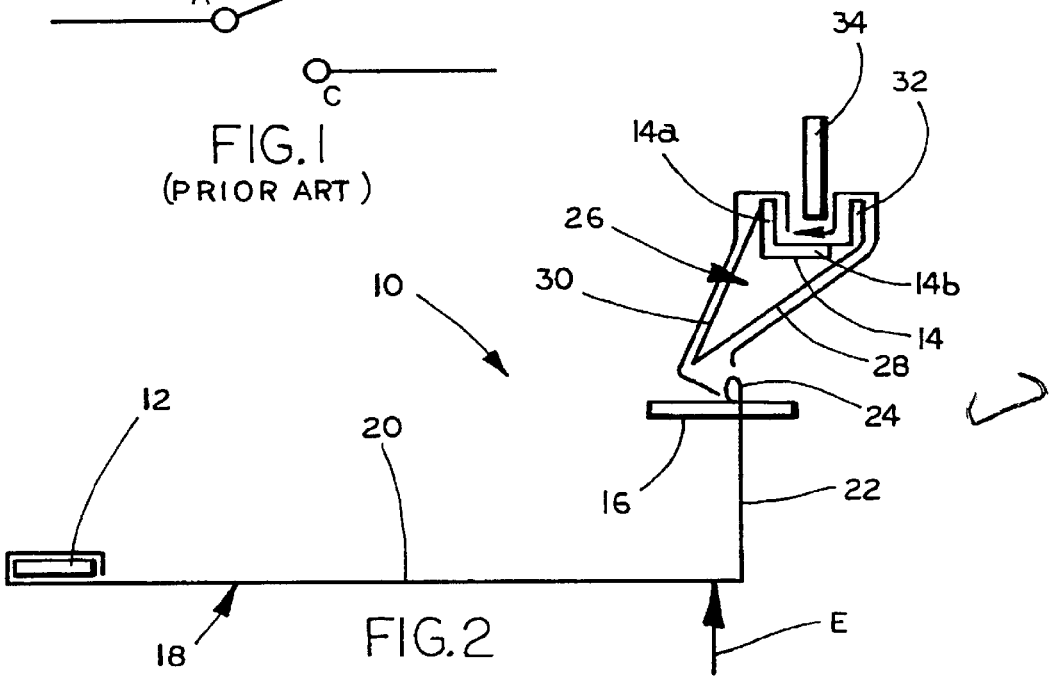
FIG. 2 is a plan view of a first embodiment of the electrical switch of the present invention.
Figure 3:
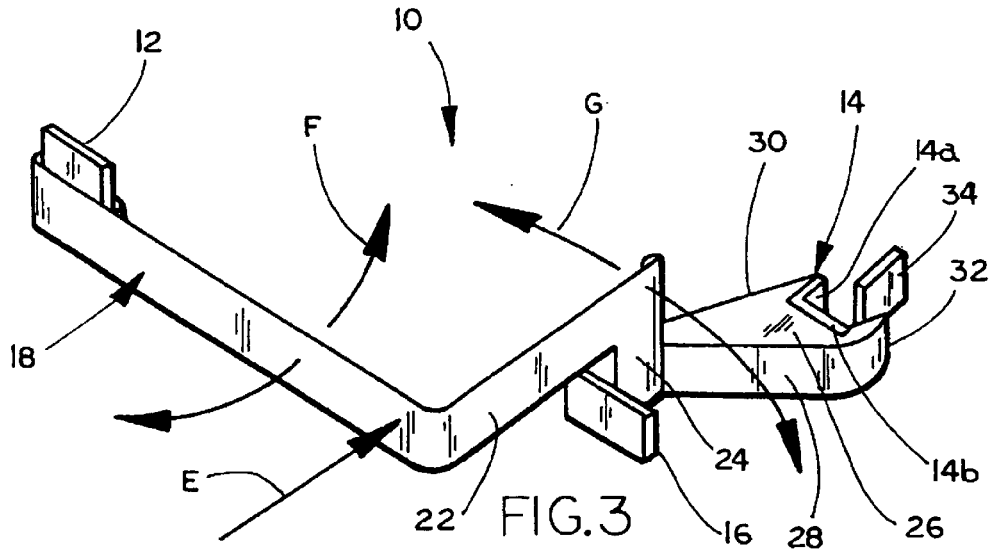
FIG. 3 is a perspective view of the electrical switch of FIG. 2.

With reference to FIGS. 2 and 3, a first embodiment 10 of the electrical switch of the present invention includes, a first pole or electrical switch contact 12 formed as part of an insert molded stamping that is integral with the desired product substrate for a lamp assembly or other accessory or control useful in vehicles. Contact 12 corresponds to point A in FIG. 1. Positions B and C of FIG. 1 correspond to contacts or stop members 14 and 16 in FIG. 2. Preferably, one of stop members 14 and 16 is connected to the electrical circuit of the vehicle and forms a second electrical switch contact. Stop members 14, 16 are upstanding portions of metal, electrically conductive bus bars or circuit members insert molded in the product substrate. A resilient, flexible electrically conductive spring member 18 is engaged with contact 12 and extends laterally from contact 12 along a first arm or portion 20 of the spring member to a second arm or portion 22 of the spring member extending at a right angle to portion 20. Second portion 22 of the spring member includes a cylindrical contact member 24 extending downwardly and adapted to be moved successively between stop members 14 and 16 to open and close the circuit between contact 12 and that stop member 14, 16 which is connected to the electrical circuit of the desired product substrate.

Preferably, stop member 14 includes portions 14*a*, 14*b* extending at a right angle to one another for receipt of contact member 24 when it is moved into engagement with that stop member. Extending in an intermediate position between stop members 14 and 16 is an upstanding, generally heart shaped, non-electrically conductive, contact directing member 26 having angled cam surfaces 28, 30 which extend at different angles to stop member 16. Extending outwardly from the contact directing member is an end extension 32 which is adjacent to but spaced from stop member 14 as well as a rigid member 34. Rigid member 34 is adapted to engage contact member 24 as explained hereinafter.

Operation of switch 10 is accomplished by applying a force in the direction of arrow E (FIGS. 2 and 3) causing flexing of the flat spring member 18 along first arm portion 20 in the direction of arrow F (FIG. 3). Thereafter, contact 24 engages inclined or angled cam surface 28 causing the second portion 22 of spring 18 to flex outwardly in the direction of arrow G (FIG. 3). As the force applied in the direction of arrow E continues, contact 24 slides along and is cammed laterally outwardly by surface 28 such that it passes around end extension 32. The resiliency of the spring arm 22 snaps contact 24 in the opposite direction against rigid member 34 as contact 24 clears the end of extension 32. Such snapping action and engagement with rigid member 34 creates an audible click or sound indicating to the switch operator that the spring has reached its second position. Release of pressure from arrow E allows the resiliency of spring arm 20 to move contact 24 back toward its first position along rigid member 34 into the space between the end of rigid member 34 and stop member 14 until the contact member comes to rest in the corner between portions 14*a*, 14*b* of stop member 14. In the event stop member 14 is connected to the electrical circuit of the product to be operated by the switch, it is also desirable to connect rigid member 34 with the electrical circuit such that rigid member 34 is electrically conductive like stop member 14. The engagement of contact member 24 with rigid member 34 as described above makes electrical contact between contact 24 and rigid member 34 thereby closing the desired circuit. When the force E against spring member 18 is released, contact member 24 moves downwardly along rigid member 34 and snaps into the corner between contact/stop member portions 14*a*, 14*b* in a fraction of a second such that the electrical current is not noticeably interrupted or affected, especially if the circuit is connected to a lamp or bulb. All pressure in the direction of arrow E may then be released such that contact member 24 is retained in and thus latched in the position of stop member 14. Should it be desired to unlatch and open the circuit controlled by switch 10, force is again applied in the direction of arrow E causing contact member 24 to move along portion 14*a* of stop member 14 past the end of that stop member. The resiliency of spring arm 20 urges contact member 24 downwardly along cam surface 30. At the end of cam surface 30, contact member 24 moves back to its original position (FIG. 2) due to the resiliency of spring arm 22 and the fact that contact 24 passes the end of cam surface 30 to the left of its normal rest position against stop member 16 as shown in FIG. 2. Another audible sound or click is created when contact member 24 passes the end of cam surface 30 and snaps against stop member 16 to indicate a return to its initial position.

It is also possible to connect stop member 16 to the electrical circuit such that stop member 14 and rigid member 34 are not connected electrically to the circuit. Therefore, spring member 18 will conduct electricity from first electrical switch contact 12 to stop member 16 thereby closing the desired circuit in the first latched position of spring 18, while movement of contact 24 by flexing the spring as described above along cam surface 28, around projection 32 and into stop member 14 opens the circuit in the second latched position. The circuit will thus remain open while contact 24 engages stop member 14 until it is again actuated to return the contact member along cam surface 30 to its initial position against stop member 16 as shown in FIG. 2. Accordingly, successive movement of the conductive spring member 18 between its two positions shown in FIGS. 2 and 3 not only latches the switch in one position or the other until again actuated by a force E, but also provides the current carrying member of the switch which opens and closes the circuit between first electrical switch contact 12 and either stop member 14 or 16 depending on which is connected electrically to the desired circuit. This is an application of a single pole, single throw switch. Alternately, both stop member 14 and 16 can be connected to the electrical circuit to operate the same accessory, motor or the like in different phases, or to different circuits for two different accessories, functions or the like. In such case, the switch would operate as a single pole, double throw switch.

Referring now to FIGS. 4–9, a second embodiment 40 of the electrical switch of the present invention is adapted for incorporation in an insert molded substrate 42 which is adapted to be mounted and assembled with the desired end product such as a rearview mirror assembly, lamp assembly or other accessory or control in a vehicle. In the embodiment shown in FIGS. 4–9, substrate 42 is a circuit module adapted for assembly in a rearview mirror assembly and includes a molded, polymeric plate preferably formed from nylon or another suitable thermoplastic polymeric material and having an extension 45 at one end through which project the formed, electrically conductive, metallic, spring-like flanges of a bulb holder 46 formed integrally with stamped circuit members 48. Circuit members 48 preferably comprise brass, steel or other metallic bus bars which are insert molded within non-conductive polymeric plate 42 and include upstanding flanges 50, 52, 54 and 56 projecting through openings in plate 42 at various positions adjacent switch 40. Switch 40 includes only two movable parts, namely, a switch actuator 60 comprising a movable button or plunger and a coil spring 80 adapted for mounting on switch actuator/button 60.

Figure 6:
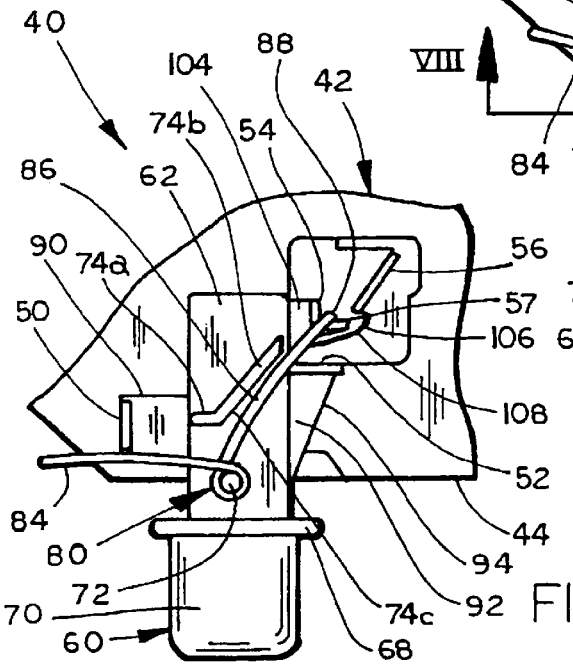
FIG. 6 is a top plan view of the assembled switch of FIG. 5 shown in a second latched position.
Figure 8:
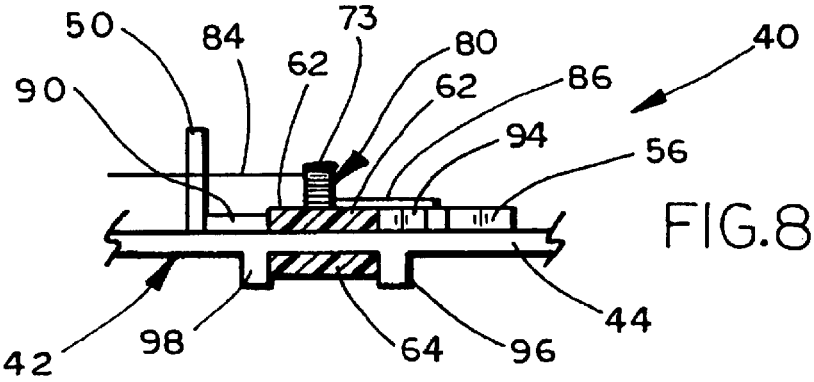
FIG. 8 is a fragmentary, sectional view of the assembled switch taken along plane VIII—VIII of FIG. 5.
Figure 9:
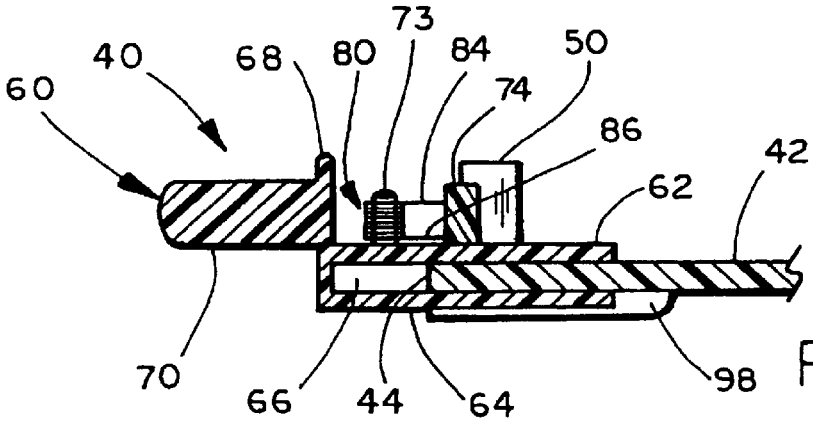
FIG. 9 is a sectional view of the assembled switch taken along plane IX—IX of FIG. 5.

Switch actuator or plunger 60 is non-electrically conductive, is a molded member preferably formed from acetal or another suitable thermoplastic, polymeric, non-conductive material in one piece, and is preferably adapted to be slidably received over edge 44 of circuit member or substrate 42 adjacent flanges/contacts 50, 52, 54 and 56. Actuator 60 includes a pair of parallel mounting flanges 62, 64 spaced from one another and defining a space 66 matching the thickness of circuit substrate 42 adjacent edge 44 (FIGS. 8 and 9). Projecting outwardly from an upstanding flange 68 at one end of mounting flange 62 is a button or actuating member 70 adapted to be pressed by the finger of an operator toward and away from edge 44 of substrate 42. Formed integrally on the outer surface of mounting flange 62 is cylindrical, spring mounting post 72 and an angled, upstanding spring engaging member 74. Spring engaging member 74 includes a short, base section 74*a*, adjacent spring post 72, and an angled spring engaging section 74*b* having an upstanding face 74*c* (FIG. 6). Preferably, post 72 includes a slightly enlarged head 73 at its outer end to retain spring 80 thereon when telescoped over post 72 as explained below.

Figure 4:
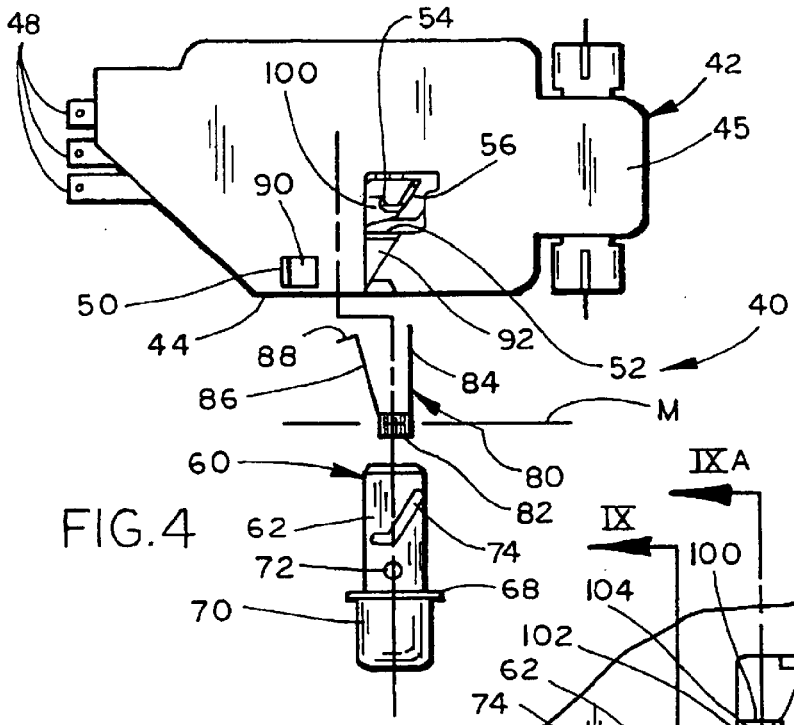
FIG. 4 is an exploded, plan view of a second embodiment of the electrical switch of the present invention adapted for mounting on an electrical circuit module substrate.
Figure 7:
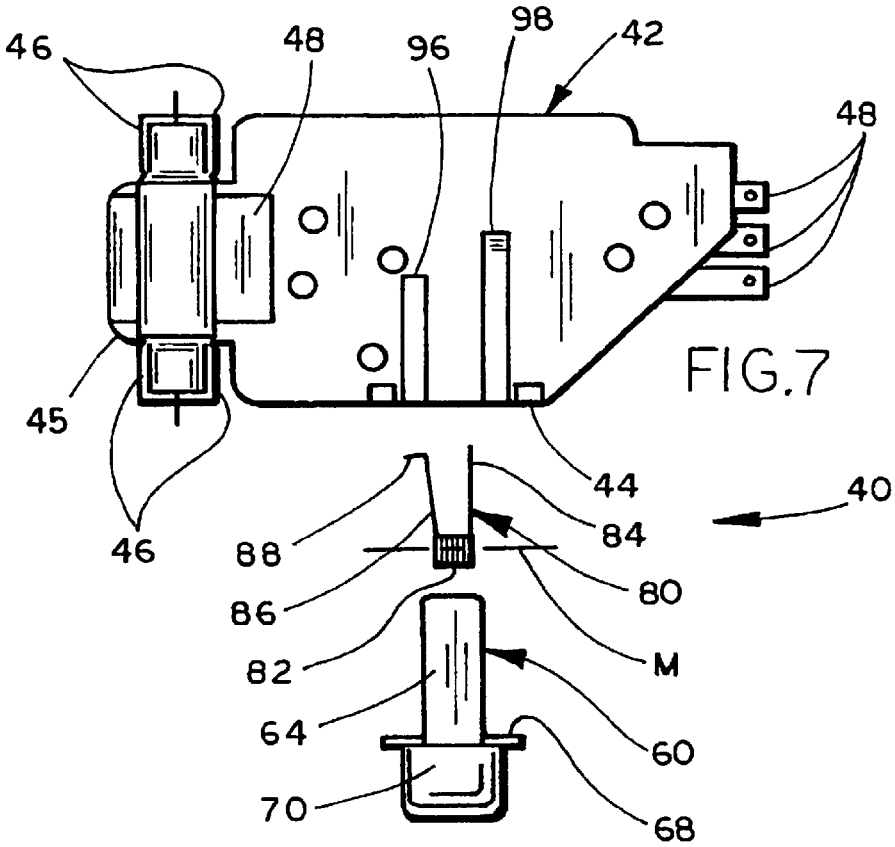
FIG. 7 is an exploded bottom plan view of the electrical switch of FIGS. 4–6 shown from the side of the circuit module opposite to that in FIG. 4.
Figure 9A:
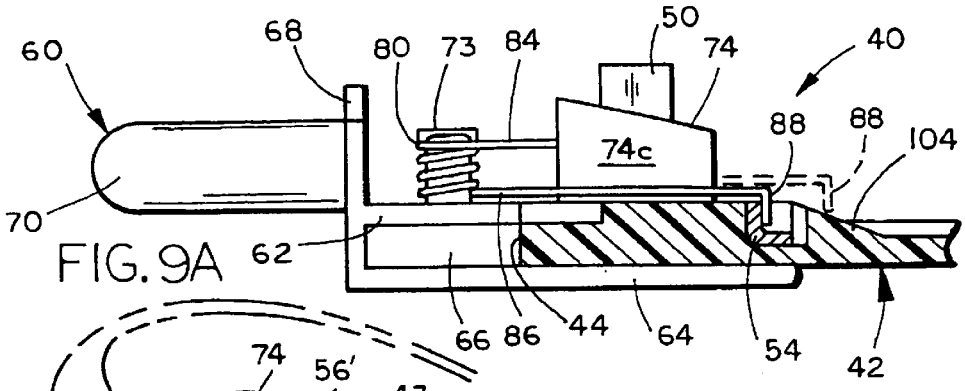
FIG. 9A is a sectional view of the assembled switch taken along plane IXA—IXA of FIG. 5.

Spring member 80 is a coil spring having coils 82 aligned axially on axis M (FIG. 7) and including an arm 84 extending outwardly from one end of the spring and a second arm 86 extending outwardly from the opposite end of the spring. Arm 86 includes a contact member 88 extending at right angle to arm 86 at its outer end (FIGS. 4, 7 and 9A). When mounted axially over post 72, coils 82 of spring 80 are prestressed such that arms 84, 86 extend in a V-shaped arrangement similar to that shown in FIG. 5 wherein spring arm 84 engages base section 74*a* of projection 74 while spring arm 86 engages surface 74*c* of projection portion 74*b*. This allows the spring arms to contact the proper portions of the switch arrangement on substrate 42 when actuator/plunger 60 is slidably mounted over edge 44 of substrate 42 as described more fully below. Preferably, spring 80 is formed from round, stainless steel wire and is electrically conductive. Alternately, other materials can be used for spring 80 such as phosphor-bronze. The diameter of the wire forming spring 80 is selected to allow the spring to carry sufficient current to operate electrical circuits typical in a vehicle environment yet provide a desired amount of force and resiliency. Spring 80 is designed to carry electrical loads of 50 watts or less thereby allowing the current/amperage and voltage to be varied in accordance with the desired product application. The diameter is also selected to provide the desired resiliency creating the appropriate operating force for the switch when actuator/plunger 60 is pushed and depressed so as not to require too large an operating force. In the preferred embodiment, the stainless steel wire has a diameter of 0.020 inches, and carries a maximum current of 0.81 amps and a maximum voltage of 16 volts.

Figure 5:
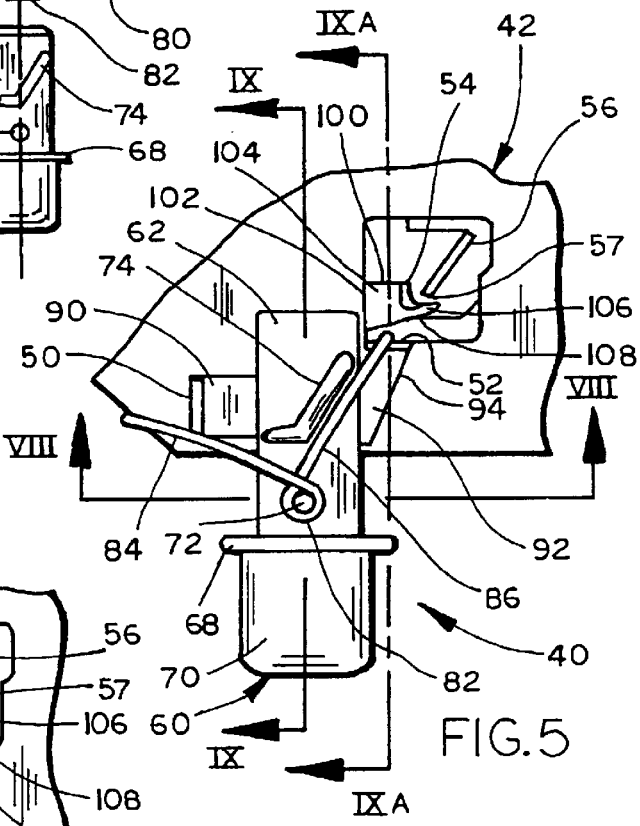
FIG. 5 is an enlarged top plan view of the assembled electrical switch of FIG. 4 when in a first latched position.

As is best seen in FIGS. 4 and 7–9, actuator 60 is adapted to be confined during its rectilinear, reciprocating movement on substrate 42 by a plurality of upstanding surfaces integrally molded with the substrate. As shown in FIG. 4, on the side of the substrate through which members 50, 52, 54 and 56 project, substrate 42 includes a generally square guide block 90 adjacent projecting flange 50, and a wedge-shaped guide block 92 adjacent flange 52. Block 92 includes an angled/inclined surface 94 adapted to engage the contact member 88 of spring arm 86 as described more fully below. Block 92 extends from a position adjacent edge 44 of substrate 42 into contact with flange 52 as shown in FIGS. 5 and 6. Blocks 90 and 92 include rectilinear facing surfaces which are substantially parallel to one another and are adapted to engage the generally parallel side surfaces of mounting flange 62 as shown in FIGS. 5 and 6. On the opposite side of substrate 42 are a pair of rectilinear guide flanges 96, 98 having parallel facing, inside surfaces adapted to engage the parallel side edges of mounting flange 64 (FIG. 8).

A third guide surface for sliding contact with mounting flange 62 of actuator 60 is provided by block 100 also integrally molded with substrate 42. Block 100 includes a side surface 102 adapted to slidably guide the edge of mounting flange 62. Surface 102 is flush with and parallel to the surface of block 92 which engages mounting flange 62. In addition, block 100 includes an upwardly inclined, cam surface 104 (FIG. 9A) adapted to engage contact 88 as it moves between its operative positions as explained more fully below. Block 100 abuts one side of flange 54. Flange 54 has an L-shape in plan view and provides a stop for contact 88 of spring arm 86 when the spring arm is engaged therewith in much the same fashion as stop member 14 in embodiment 10 of the present invention. In addition, block 100 has an extending end 106 defining the end of a cam surface 108 which a contact directing member that engages contact member 88 when the switch is moved between its operative positions. Flange 56 provides a rectilinear rigid member extending at an angle toward flange 54 but having an end edge 57 spaced sufficiently from end 106 and flange 54 to allow the passage of contact member 88 on spring arm 86 therebetween as described below.

Assembly and operation of switch 40 will now be understood. Spring 80 is mounted over headed post 72 such that arm 84 engages base 74*a* of member 74 while spring arm 86 engages surface 74*c* of the member 74. The spring member is thus held in a V position. With the spring so mounted, actuator 60 is positioned in alignment between block 90 and blocks 92, 100 on one surface of substrate 42 with mounting flange 64 aligned between guide flanges 96, 98 on the opposite surface of the substrate adjacent edge 44. Actuator 60 is then moved toward edge 44 between the guide surfaces such that contact 88 on arm 86 engages angled surface 94. As actuator 60 is moved inwardly, contact 88 slides along surface 94 while spring arm 84 engages the edge of flange 50 (FIG. 5). Continued movement of the actuator flexes spring arm 86 outwardly as contact 88 slides along cam surface 94 until the end of that surface and flange 52 is reached after which contact 88 moves inwardly toward projection 74 along the surface of flange 52 until arm 86 again engages surface 74*c* of member 74 (FIG. 5). Downwardly extending contact member 88 thereafter holds plunger 60 in its assembled, first latched position against the resiliency of the spring arms that are slightly flexed when engaged with flange 50, surface 74*c* and flange 52 as shown in FIG. 5. The resiliency of the flexed spring arms urges and holds actuator 60 in that position. Flange 50 is preferably connected to the electrical circuit in substrate 42. In the event that flange 52 is also connected to the electrical circuit via bus bars 48, spring member 80 conducts electricity from flange 50 therethrough to flange 52 thereby completing the circuit and operating the vehicle accessory connected to the circuit. However, and optionally, flange 52 may not be connected to the circuit in which case flanges 54, 56 are electrically connected such that spring 80 will make electrical connection to complete and close the circuit when moved to its second latched position as described below. Either one of these alternate connections is an example of the switch connected for single pole, single throw operation. Alternately, connection of all flanges 52, 54 and 56 to different phases of one electrical circuit or to two different circuits would allow the switch to operate as a single pole, double throw switch.

Inward pressure on actuator 60 by the finger of an operator against the resiliency of spring 80 causes spring arm 84 to further flex while contact 88 engages cam surface 108 of block 100 as shown in FIGS. 5 and 6. Continued inward movement of the actuator/plunger forces contact member around the end 106 of block 100. The resiliency of the flexed spring arm 86 causes the contact end 88 to snap inwardly toward member 74 until it strikes flange 56. Such striking engagement under the force of the spring causes an audible sound or click which may be heard by the switch operator. When flanges 56 and 54 are connected to the electrical circuit, the circuit is closed at that moment thereby operating the light or other accessory. When finger pressure on actuator 60 is thereafter released, the resiliency of the spring urges contact 88 along the angled surface of flange 56 until it reaches end 57 and the opening between flanges 56, and 106 and flange 54, at which point spring contact 88 snaps against flange 54 creating a second audible sound or click which may be heard by the switch operator after his finger is released. Such second audible sound indicates that the switch has reached its second latched position. As mentioned above, in the event that flanges 54, 56 are connected to the electrical circuit, the circuit is closed at this position with contact 88 engaging flange 54 such that the light or other accessory continues to operate. The momentary interruption of current flow as contact 88 passes from flange 56 past end 57 into contact with flange 54 is so short (approximately 0.005 seconds) that no visible interruption of light from the lamp or interruption of operation of the accessory is noticed by the operator. When switch actuator 60 is moved inwardly or depressed and then released in the above described fashion at a rapid pace, the switch contact moves successively from flange 52 to flange 56 and then to flange 54 in rapid succession such that two audible sounds or clicks are heard indicating the switch has reached its second latched position shown in FIG. 6. In this position, spring arms 84, 86 are more severely bent than in the first latched position shown in FIG. 5 such that actuator 60 is held in such position, and a somewhat greater force is necessary to further depress actuator 60 to return it to its first latched position as explained below.

When it is desired to return the switch to its first latched position shown in FIG. 5 from that of the second latched position shown in FIG. 6, actuator 60 is further depressed thereby moving contact 88 along flange 54. When the end of flange 54 is reached by contact 88, the resilient spring force urges it inwardly toward member 74 until spring arm 88 again contacts the surface 74*c*. At this point, contact 88 is aligned with inclined surface 104 as shown in FIG. 9A. Such movement snaps arm 86 against surface 74*c* causing another audible sound or click which may be heard by switch operator. Thereafter, when actuator 60 is released, the resilient force of the spring 80 urges the actuator outwardly due to contact between spring arm 84 and flange 50. Spring contact 88 slides upwardly over the inclined cam surface 104 as shown in FIG. 9A and snaps against flange 52 as actuator 60 again reaches its first latched position. Such snapping action creates a fourth audible sound or click which may also be heard by the switch operator indicating the switch has returned to the first latched position. As mentioned above, depending on which flanges are connected to the circuit in substrate 42, the lamp or other accessory will either be "on" or "off" in the first latched position. Accordingly, movement of actuator/plunger 60 between its first and second latched positions, while spring arm 84 remains engaged with the edge of flange 50, causes contact 88 to move between flange 52 and flanges 54, 56 to open and close the electrical circuit to which flanges 50 and 52 or 54, 56 are electrically connected with electrical current passing through the spring member 80. Alternately, as mentioned above, all of the flanges 50, 52, 54 and 56 may be connected to electrical circuits for single pole, double throw operation. Spring 80 also serves as the motive force for retaining the switch in its first or second latched position and provides resistance against which the switch actuator is operated.

Figure 10:
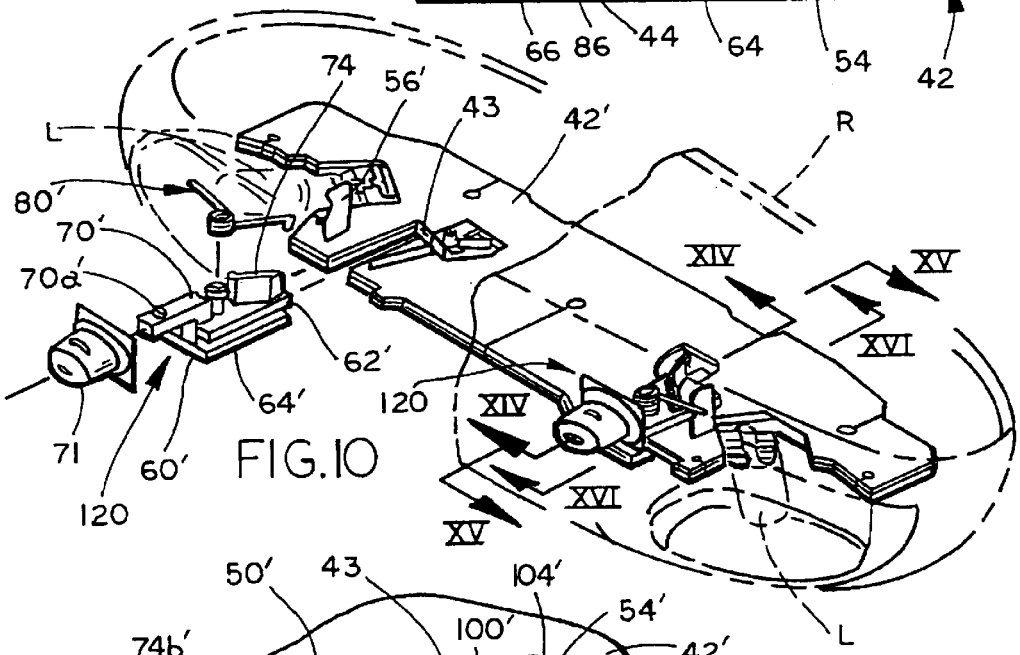
FIG. 10 is a perspective view, shown partially exploded, of a second embodiment of the electrical switch adapted to operate lamps on a circuit module mounted in an interior rearview mirror assembly for vehicles.
Figure 11:
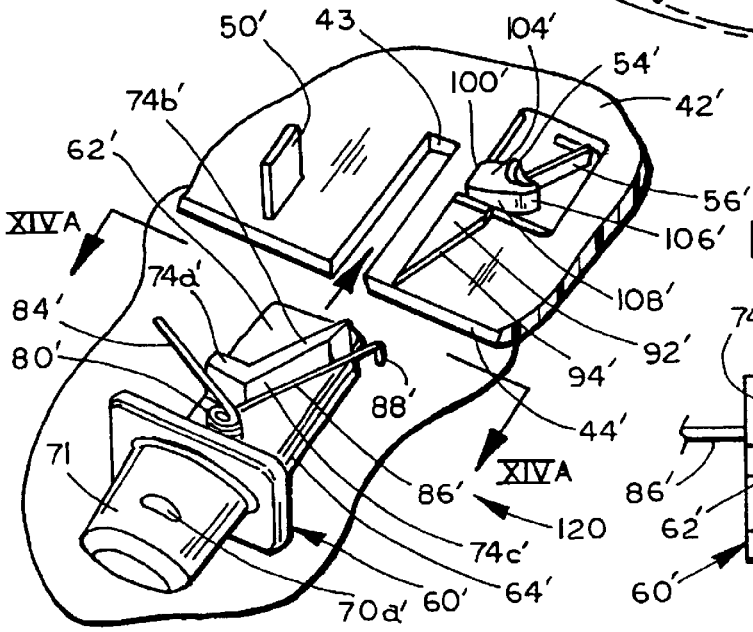
FIG. 11 is an exploded, perspective view of the electrical switch of FIG. 10 prior to installation on the circuit module substrate.
Figure 14A:
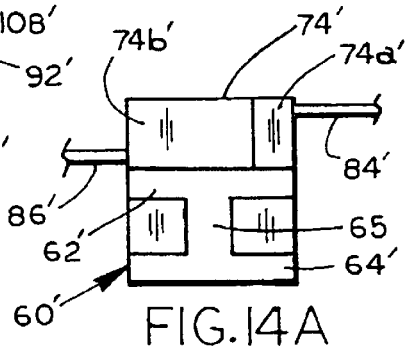
FIG. 14A is an end view of the switch actuator of the electrical switch of FIGS. 10–14 taken along plane XIVA—XIVA of FIG. 11.
Figure 12:
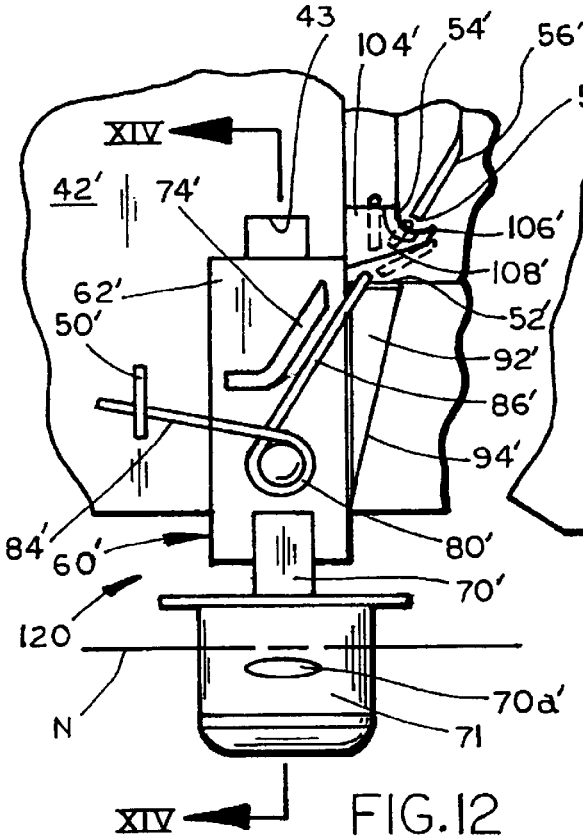
FIG. 12 is a top plan view of the electrical switch of FIGS. 11 and 12.
Figure 13:
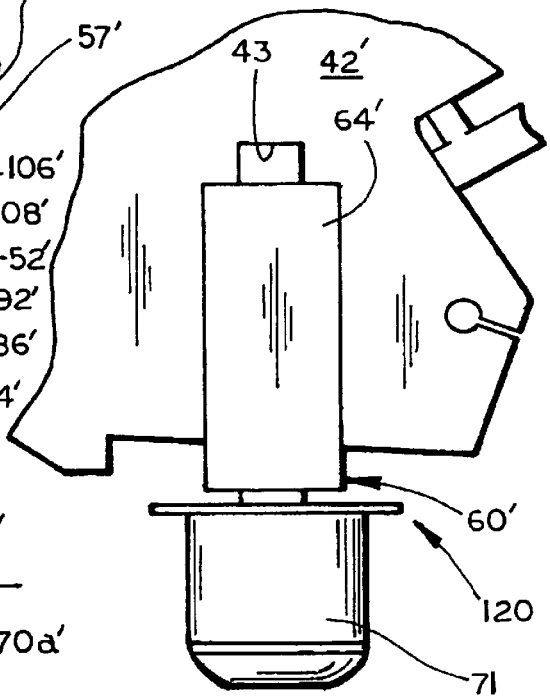
FIG. 13 is a bottom plan view of the electrical switch of FIGS. 11 and 12.
Figure 14:
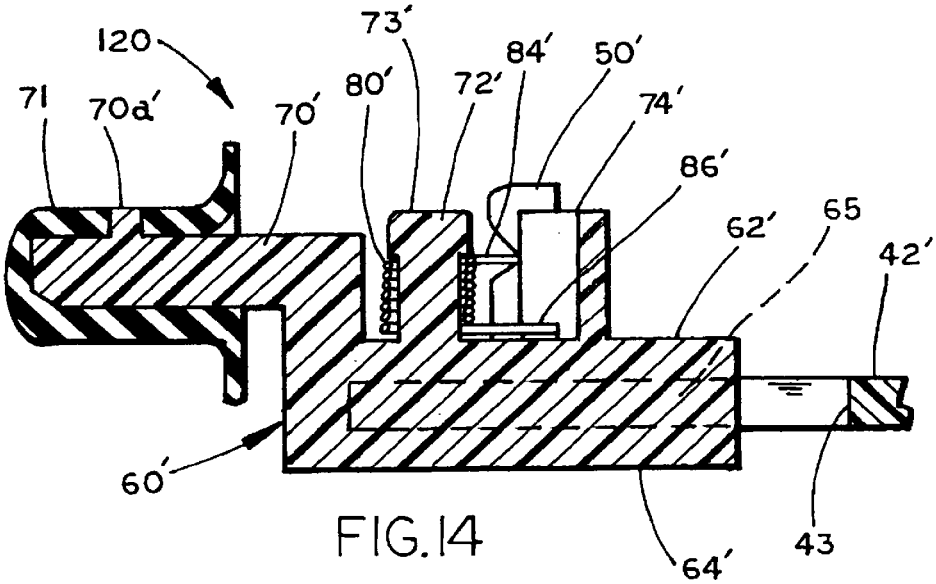
FIG. 14 is a sectional side elevation of the electrical switch of FIGS. 10–13 when mounted on the circuit module substrate taken along plane XIV—XIV of FIG. 10.
Figure 15:
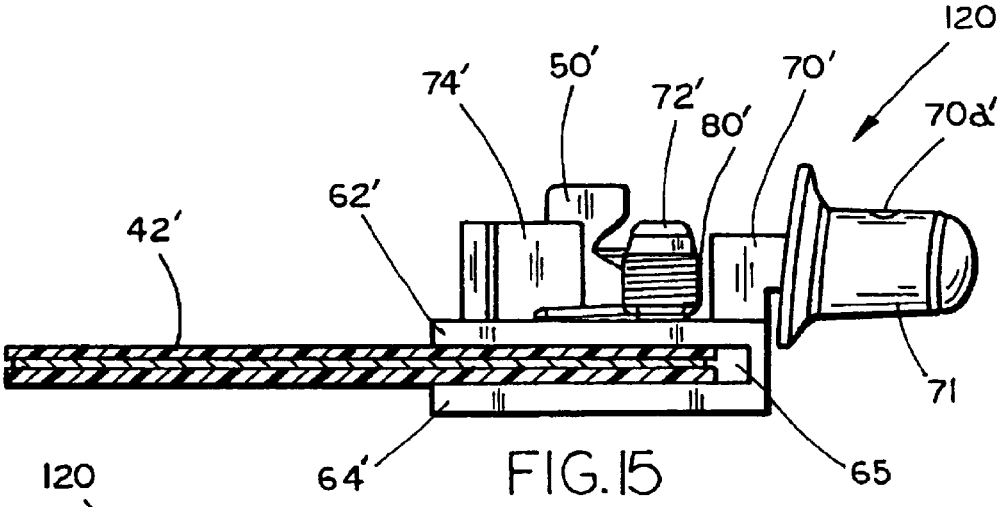
FIG. 15 is a sectional side elevation of the assembled electrical switch taken along plane XV—XV of FIG. 10.
Figure 16:
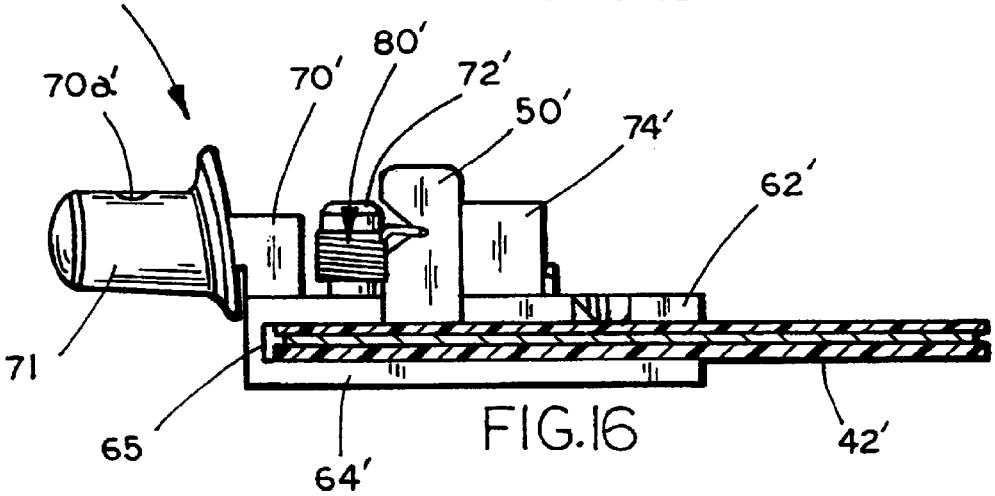
FIG. 16 is a sectional side elevation of the assembled electrical switch taken along plane XVI—XVI of FIG. 10.

A third embodiment 120 of the electrical switch of the present invention is shown in FIGS. 10–16 where like parts to those of switch 40 are shown by like primed numerals. As shown in FIG. 10, a pair of switches 120 is assembled to a circuit member or substrate 42' which is adapted to be mounted within a rearview mirror assembly R of the type including a pair of map or reading lights L. Each light L is operated by one of the switches 120. Each switch 120 is similar in structure and operation to switch 40, but includes a modified mounting therebetween actuator 60' and substrate 42'. Switch 120 includes a non-conductive switch actuator or plunger 60' molded in one piece and including mounting flanges 62', 64' from which an L-shaped operating flange or button 70' extends outwardly. A nonconductive, flexible, molded, polymeric or rubber cap 71 is slidably mounted over the projecting end of flange 70' to serve as an operating surface for the actuator/plunger. In addition, an oval or round projection 70*a*' extends through an opening in cap 71 as an indicator, especially when the cap is formed from a dark material and actuator/plunger 60' is molded from a light or white polymeric material. Instead of blocks or flanges engaging the edges of mounting flanges 62', 64' as in switch 40 described above, switch 120 includes a central flange 65 extending between the inside surfaces of flanges 62, 64 as shown in FIGS. 14 and 14A providing actuator 60' with an I-beam shape in section as shown in FIG. 14A. Flange 65 is adapted to be received in rectilinear slot 43 formed in the edge 44' of substrate 42'. Thus, the inside edges of slot 43 engage opposite surfaces of center flange 65 while the inside surfaces of mounting flanges 62', 64' engage the top and bottom surfaces of substrate 42' to guide the rectilinear reciprocal movement of actuator/plunger 60' as it is moved to operate the switch 120.

Switch 120 is assembled and operated in substantially the same manner as switch 40 described above. With coil spring member 80' mounted on headed post 72' in a shallow V shape by engagement with member 74' (FIG. 11), center flange 65 is aligned with slot 43 and actuator 60' is moved inwardly over the edge 44' of the substrate. Contact 88' of spring arm 86' moves along surface 94' until it snaps inwardly over the end of flange 52' into engagement with member 74' thereby retaining the switch actuator in its first latched position (shown in solid in FIG. 12). Further inward movement of actuator 60' along slot 43 causes contact member 88' to engage surface 108' and flex laterally outwardly until it passes end 106' and snaps laterally inwardly against flange 56' creating an audible sound or click. Release of the plunger allows the spring resiliency to move the plunger slightly oppositely (outwardly of edge 44') until contact member 88' passes end 57' between flange 56' and flange 54' into its second latched position as shown in phantom in FIG. 12. Depending on whether flange 52' or flanges 54', 56' are connected to the electrical circuit, the switch 120 will close the circuit in either its first latched position or its second latched position as desired for single pole, single throw operation. Of course, single pole, double throw operation is possible if all contacts 52', 54' and 56' are connected to one or different electrical circuits. Return of the switch to its first latched position from its second latched position is accomplished by another depression of actuator/plunger 60' thereby moving contact member along flange 54' until the end is reached when contact member 88' snaps inwardly against member 74' creating an audible sound or click and aligning the contact member with inclined surface 104'. Release of the actuator/plunger 60' allows the resiliency of the spring to return the plunger outwardly with contact member 88' passing upwardly and over the inclined cam surface 104' until it snaps against flange 52' in its first latched position and again creating another audible sound or click heard by the switch operator. In the event the substrate 42' and switch 120 are mounted in a vehicle such as in a rearview mirror assembly, light assembly or the like with a portion of that assembly reaching line N (FIG. 12), indicator 70*a*' would be visible when the switch is in its first latched position such that the cap 71 projects farther outwardly than in its second latched position. The first latched position would thus preferably be the "on" position for the circuit or light or other accessory because indicator 70*a*' is visible. However, when switch actuator 60' is moved inwardly causing the switch to move to its second latched position, the circuit would be opened and indicator 70*a*' would not be visible, thereby preferably indicating to the switch operator that the accessory is in its "off" position.

Figure 17:
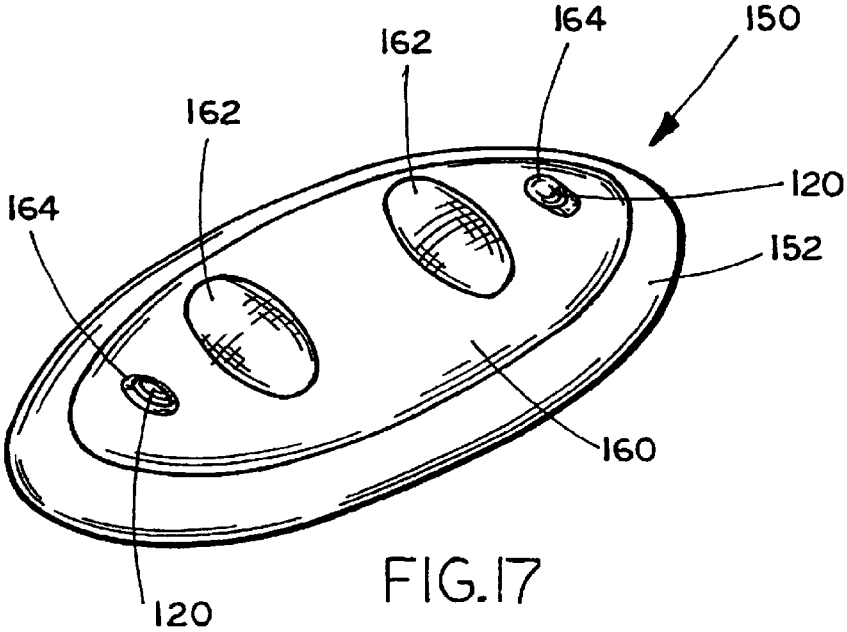
FIG. 17 is a perspective view of an interior dome lamp assembly for vehicles incorporating a pair of switches of the present invention.
Figure 18:
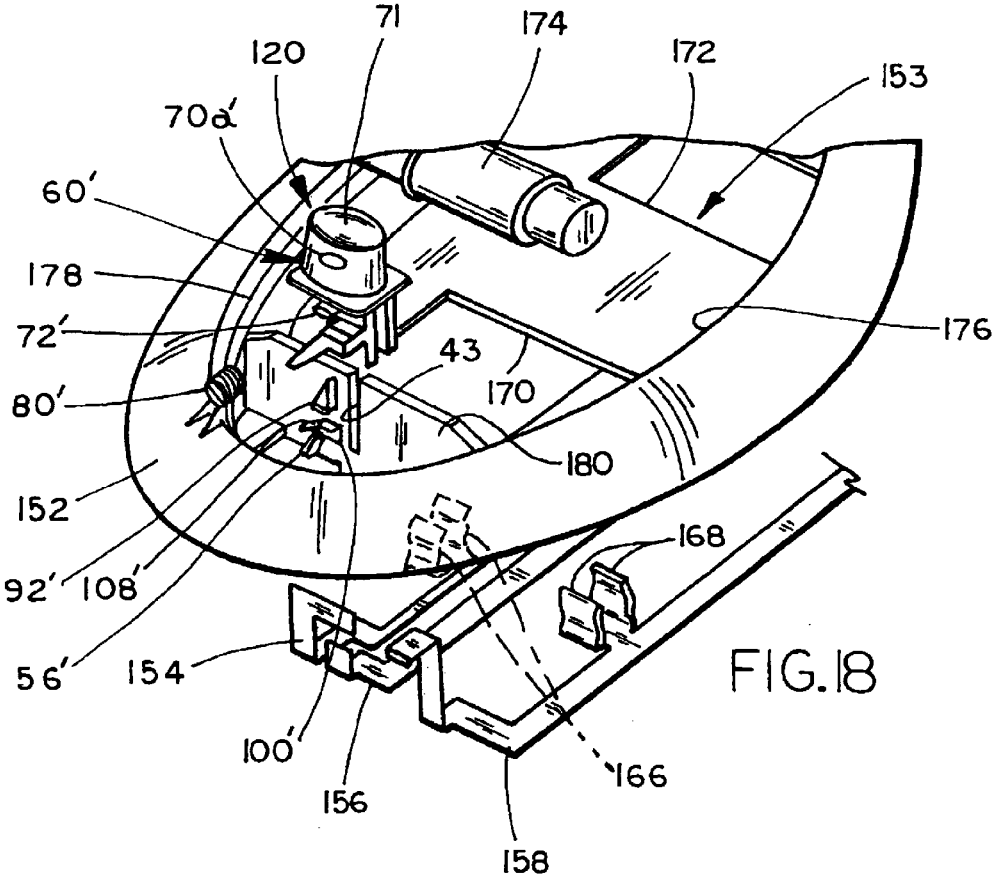
FIG. 18 is an exploded, perspective view of one of the switches of FIG. 17 prior to installation in the dome lamp assembly.

As an alternative to incorporating switches 120 on a circuit module or substrate 42' in an interior rearview mirror assembly R in a vehicle, switches 120 may alternately be incorporated in other vehicle accessories such as an interior dome light assembly 150 shown in FIGS. 17 and 18. In this application, dome light assembly 150 includes an oval or other suitably shaped frame 152 preferably molded from a polymeric material such as nylon, a series of stamped, metallic, electrically conductive bus bars 154, 156, 158 which are either secured to or insert molded within frame 152, and a pair of electrical switches 120 assembled to the frame 152 as hereinafter described. In addition, a heat resistant, molded lens insert 160 preferably formed from polycarbonate includes lens portions 162 as well as switch apertures 164 adjacent either end of the assembly. A pair of the conductive bus bars 154, 158 include spring like lamp/bulb holders 166, 168 formed integrally with the bus bars and adapted to project through apertures 170, 172 formed in frame 152 for receipt of cartridge type lamps or bulbs 174 within a central, recessed area 153 of frame 152. Lens insert 160 is adapted to snap into and be received within aperture 176 defining the central recessed area 153 of dome light assembly 150 by means of a recessed shoulder 178 (FIG. 18). Adjacent each end of frame 152 within central recessed area 153 is an upstanding wall 180 to which one of the switches 120 is assembled. Wall 180 includes slot 43 into which one of the switch actuators/plungers 60' is slidably mounted after coil spring member 80' is assembled on headed post 72' in the manner described for switch 120 in FIGS. 10–16 above. Blocks 92' and 100' are integrally molded on wall 180 of frame 152 near slot 43 while electrical contacts 50', 52', 54' and 56' are formed on bus bars 154, 156, 158 in similar positions to those shown in FIGS. 10–16 when the bus bars are assembled to the frame 152. Accordingly, each switch 120 may be operated to open and close the circuits defined by bus bars 154, 156 and 158 to operate individual lamps/bulbs 174 by pressing button/plunger 70' covered by cap 71' which extends outwardly through aperture 164 in the manner described above. Indicator 70*a*' will preferably be visible beyond the lens insert 160 and aperture 164 when the circuit is on and bulb 174 is activated and actuator/plunger 60' is in its first latched position, but be positioned below the surface of lens insert 160 when actuator/plunger 60' is depressed and in its second latched position within frame 152 and lens insert 160. Accordingly, the electrical switches of the present invention may be applied to various assemblies in a vehicle, appliance or other application to operate a variety of lamps, accessories or controls on individual circuits connected to an electrical system.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow, and interpreted under the principles of patent law including the Doctrine of Equivalents.

The embodiments of the invention in which an exclusive property or privilege is claimed are as follows:

1. An electrical switch for vehicles, appliances, and the like, comprising:

a first electrical switch contact at a first position;

an electrically conductive, resilient spring member having a first portion engaged with said first electrical switch contact and a second portion movable between second and third positions, said second and third positions being spaced from one another and from said first position;

a second electrical switch contact at one of said second and third positions, said second electrical switch contact adapted for engagement by said second spring portion;

whereby when said first and second electrical switch contacts are connected to an electrical circuit, movement of said second portion of said spring member between said second and third positions engages and disengages said second spring portion with said second electrical switch contact while said first spring portion remains engaged with said first electrical switch contact to thereby open the electrical circuit or close the electrical circuit allowing current to pass through said spring member.

2. The switch of claim 1 including a contact directing member positioned between said second and third positions, said contact directing member including a cam surface that directs said second portion of said spring member between said second and third positions for engagement and disengagement with said second electrical switch contact.

3. The switch of claim 2 wherein said cam surface directs said second portion of said spring member from said second to said third position; said switch further including a second contact directing member positioned between said second and third positions, said second contact directing member including a second cam surface that directs said second portion of said spring member from said third to said second position.

4. The switch of claim 3 wherein said spring member is a flat spring, said second portion of said spring member extending at a right angle to said first portion of said spring member.

5. The switch of claim 3 including a switch actuator movable between at least two positions; said spring being mounted on and movable with said actuator.

6. The switch of claim 5 wherein said switch actuator is movable linearly along a first direction; said cam surface directs said second portion of said spring member in a second direction laterally of said first direction.

7. The switch of claim 6 wherein said second cam surface directs said second portion of said spring member in a third direction different from said first and second directions.

8. The switch of claim 5 including a switch support comprising at least portions of the electrical circuit; said switch actuator being movably mounted on said switch support.

9. The switch of claim 8 wherein said first and second electrical switch contacts are on said switch support.

10. The switch of claim 5 wherein said spring member is a coil spring having a coil with two ends, an axis for said coil, a first arm at one end of said coil extending outwardly away from said coil axis, and a second arm at the other end of said coil extending outwardly away from said coil axis, said first arm comprising said first portion of said spring member, said second arm comprising said second portion of said spring member.

11. The switch of claim 10 wherein said switch actuator includes a post over which said coil spring is axially mounted, said first and second arms extending outwardly away from said post, said switch actuator being formed from non-electrically conductive material.

12. The switch of claim 10 wherein said second arm of said coil spring includes an electrical contact extending at an angle to said second arm, said electrical contact adapted to engage said first and second stop members.

13. The switch of claim 1 including a switch actuator movable between at least two positions; said spring being mounted on and movable with said actuator.

14. The switch of claim 1 including a third electrical switch contact at the other of said second and third positions which does not comprise said one of said second and third positions; whereby when said first, second and third electrical switch contacts are connected to at least one electrical circuit, movement of said second portion of said spring member between said second and third positions engages and disengages said second spring portion successively with said second and third electrical switch contacts to thereby successively open and close the electrical circuit with, and allow electrical current to pass through said spring member to, said respective second and third electrical switch contacts.

15. An electrical switch for vehicles, appliances, and the like, comprising:

a first electrical switch contact at a first position;

an electrically conductive, resilient spring member having a first portion engaged with said first electrical switch contact and a second portion movable between second and third positions, said second and third positions being spaced from one another and from said first position;

a second electrical switch contact at one of said second and third positions;

whereby when said first and second electrical switch contacts are connected to an electrical circuit movement of said second portion of said spring member between said second and third positions engages and disengages said second spring portion with said second electrical switch contact to thereby open the electrical circuit or close the electrical circuit allowing current to pass through said spring member;

a contact directing member positioned between said second and third positions, said contact directing member including a cam surface that directs said second portion of said spring member between said second and third positions for engagement and disengagement with said second electrical switch contact;

said cam surface directing said second portion of said spring member from said second to said third position; said switch further including a second contact directing member positioned between said second and third positions, said second contact directing member including a second cam surface that directs said second portion of said spring member from said third to said second position;

a switch actuator movable between at least two positions; said spring being mounted on and movable with said actuator;

a switch support comprising at least portions of the electrical circuit; said switch actuator being movably mounted on said switch support;

said first and second electrical switch contacts being on said switch support; and a first stop member at said second position and a second stop member at said third position; said second electrical switch contact comprising one of said first and second stop members.

16. The switch of claim 15 wherein said spring member is extended when said second portion of said spring member is in said second and third positions such that the resiliency of said spring member urges said switch actuator toward one of said two actuator positions when said second spring portion is in said second and third positions.

17. The switch of claim 15 including a first rigid member adjacent said first stop member and a second rigid member adjacent said second stop member, said second spring portion engaging said first rigid member to provide an audible sound when said second portion of said spring member is moved from said second to said third positions.

18. The switch of claim 17 wherein said second spring portion engages said second rigid member to provide an audible sound when said second portion of said spring member is moved from said third position to said second position.

19. The switch of claim 18 wherein said second portion of said spring member engages said second stop member to provide another audible sound when said second spring portion moves from said second rigid member to said second stop member.

20. The switch of claim 17 wherein said second portion of said spring member engages said first stop member to provide another audible sound when said spring portion moves from said first rigid member to said first stop member.

21. An electrical switch for vehicles, appliances, and the like, comprising:

a first electrical switch contact at a first position;

a second electrical switch contact at a second position spaced from said first position;

a resilient spring member having a contact member movable in at least two dimensions and engageable with and movable between said first and second electrical switch contacts when a force is applied to said spring member, said spring member comprising an electrical conductor; and a contact directing member positioned between said first and second electrical switch contacts and including a cam surface, said cam surface directing said contact member from said first position to said second position for successive engagement of said contact member with said first and second electrical switch contacts when said spring member is moved;

whereby when one of said first and second electrical switch contacts and said spring member are connected to an electrical circuit, movement of said contact member between said first and second positions by application of force to said spring member causes successive engagement of said contact member with said first and second electrical switch contacts while said spring member remains connected to the electrical circuit to open the electrical circuit or close the electrical circuit allowing current to pass through said spring member.

22. The switch of claim 21 wherein said cam surface directs said second portion of said spring member from said second to a third position; said switch further including a second contact directing member positioned between said second and third positions, said second contact directing member including a second cam surface that directs said second portion of said spring member from said third to said second position.

23. The switch of claim 21 including a switch actuator movable between at least two positions; said spring being mounted on and movable with said actuator.

24. The switch of claim 23 including a switch support comprising at least portions of the electrical circuit; said switch actuator being movably mounted on said switch support.

25. The switch of claim 23 wherein said spring member is a coil spring having a coil with two ends, an axis for said coil, a first arm at one end of said coil extending outwardly away from said coil axis, and a second arm at the other end of said coil extending outwardly away from said coil axis, said first arm comprising said first portion of said spring member, said second arm comprising said second portion of said spring member.

26. The switch of claim 25 wherein said switch actuator includes a post over which said coil spring is axially mounted, said first and second arms extending outwardly away from said post, said switch actuator being formed from non-electrically conductive material.

27. The switch of claim 21 wherein an audible sound is produced when said contact member engages said second electrical switch contact.

28. The switch of claim 27 wherein another audible sound is produced when said contact member is moved from said second electrical switch contact to said first electrical switch contact.

29. The switch of claim 21 wherein both of said first and second electrical switch contacts and said spring member are adapted to be connected to at least one electrical circuit, wherein movement of said contact member between said first and second positions and successive engagement of said contact member with said first and second electrical switch contacts successively opens and closes the electrical circuit with, and allows electrical current to pass through said spring member to, said respective first and second electrical switch contacts.

30. An electrical switch for vehicles, appliances, and the like, comprising:

a first electrical switch contact at a first position;

a second electrical switch contact at a second position spaced from said first position;

a resilient spring member having a contact member movable in at least two dimensions and engageable with and movable between said first and second electrical switch contacts when a force is applied to said spring member, said spring member comprising an electrical conductor; and a contact directing member positioned between said first and second electrical switch contacts and including a cam surface, said cam surface directing said contact member from said first position to said second position for successive engagement with said first and second electrical switch contacts when said spring member is moved;

whereby when one of said first and second electrical switch contacts and said spring member are connected to an electrical circuit, movement of said contact member between said first and second positions by application of force to said spring member causes successive engagement of said contact member with said first and second electrical switch contacts to open the electrical circuit or close the electrical circuit allowing current to pass through said spring member;

a switch actuator movable between at least two positions; said spring being mounted on and movable with said actuator;

a switch support comprising at least portions of the electrical circuit; said switch actuator being movably mounted on said switch support; and a first stop member at said second position and a second stop member at a third position; said second electrical switch contact comprising one of said first and second stop members.

31. The switch of claim 30 wherein said spring member is extended when said second portion of said spring member is in said second and third positions such that the resiliency of said spring member urges said switch actuator toward one of said two actuator positions when said second spring portion is in said second and third positions.

32. An electrical switch for vehicles, appliances, and the like, comprising:

a first electrical switch contact at a first position;

a first stop member at a second position;

a second stop member at a third position, said third position being spaced from said second position, said second and third positions both being spaced from said first position, at least one of said first and second stop members being electrically conductive and comprising a second electrical switch contact;

a resilient spring member having a contact member movable in at least two dimensions and engageable with and movable between said first and second stop members when a force is applied to move said spring member, said spring member comprising an electrical conductor; and a contact directing member positioned between said first and second stop members, said contact directing member including a cam surface, said cam surface directing said contact member from said second position to said third position for successive engagement with said first and second stop members when said spring member is moved;

whereby when said first and second electrical switch contacts are connected to an electrical circuit, movement of said contact member between said second and third positions by application of force to said spring member causes successive engagement of said contact member with said first and second stop members to open the electrical circuit or close the electrical circuit between first and second switch contacts and allow current to pass through said spring member.

33. The switch of claim 32 including a switch actuator movable between at least two positions; said spring being mounted on and movable with said actuator, said switch actuator being non-electrically conductive.

34. The switch of claim 33 including a switch support comprising at least portions of the electrical circuit; said switch actuator being movably mounted on said switch support.

35. The switch of claim 33 wherein said spring member is a coil spring having a coil with two ends, an axis for said coil, a first arm at one end of said coil extending outwardly away from said coil axis, and a second arm at the other end of said coil extending outwardly away from said coil axis, said first arm comprising said first portion of said spring member, said second arm comprising said second portion of said spring member.

36. The switch of claim 32 wherein an audible sound is produced when said contact member engages said second electrical switch contact.

37. The switch of claim 36 wherein another audible sound is produced when said contact member is moved from said second electrical switch contact to said first electrical switch contact.

38. The switch of claim 32 wherein said cam surface directs said second portion of said spring member from said second to said third position; said switch further including a second contact directing member positioned between said second and third positions, said second contact directing member including a second cam surface that directs said second portion of said spring member from said third to said second position.

39. The switch of claim 32 wherein the other of said first and second stop members is also electrically conductive and comprises a third electrical switch contact, whereby when said first, second and third electrical switch contacts are connected to at least one electrical circuit, movement of said contact member between said second and third positions engages and disengages said contact member successively with said second and third electrical switch contacts to thereby successively open and close the electrical circuit with, and allow electrical current to pass through said spring member to, said respective second and third electrical switch contacts.

40. An electrical switch for vehicles, appliances, and the like, comprising:

a switch support including at least portions of an electrical circuit;

a first electrical switch contact at a first position on said switch support;

a second electrical switch contact on said switch support at a second position spaced from said first position;

a stop member on said switch support at a third position spaced from said first and said second positions;

a switch actuator mounted for movement on said switch support between at least two positions, said switch actuator being non-electrically conductive;

an electrically conductive, resilient spring member mounted on said switch actuator, said spring including a first portion engaged with said first electrical switch contact and a second portion movable between said second electrical switch contact and said stop member, said spring urging said switch actuator toward one of its positions;

whereby when said first and second electrical switch contacts are connected to the electrical circuit, movement of said switch actuator between its two positions against the resistance of said spring member causes said second spring portion to move between engagement with said second switch contact and said stop member and vice-versa while said first portion of said spring member remains engaged with said first electrical switch contact to thereby open the electrical circuit or close the electrical circuit allowing current to pass through said spring member.

41. An electrical switch for vehicles, appliances, and the like, comprising:

a first electrical switch contact at a first position;

a second electrical switch contact at a second position spaced from said position;

a stop member at a third position and spaced from said first and second positions; and an electrically conductive, resilient spring member having a first portion engaged with said first electrical switch contact and a second portion movable between said second electrical switch contact and said stop member;

whereby when said first and second electrical switch contacts are connected to an electrical circuit, movement of said second portion of said spring member between said second electrical switch contact and stop member engages and disengages said second spring portion with said second electrical switch contact while said first portion of said spring member remains engaged with said first electrical switch contact to thereby open the electrical circuit or close the electrical circuit allowing current to pass through said spring member.

* * * * *

UNITED STATES PATENT AND TRADEMARK OFFICE

CERTIFICATE OF CORRECTION

PATENT NO. : 6,953,905 B2
APPLICATION NO. : 10/447641
DATED : October 11, 2005
INVENTOR(S) : Edward Roger Adams It is certified that error appears in the above-identified patent and that said Letters Patent is hereby corrected as shown below:

Column 13:
Line 46, Claim 15, “circuit movement” should be --circuit, movement--.

Signed and Sealed this

Twenty-seventh Day of January, 2009

JOHN DOLL
*Acting Director of the United States Patent and Trademark Office*